US005586751A

United States Patent [19]

Ueno et al.

[11] Patent Number: 5,586,751

[45] Date of Patent: Dec. 24, 1996

[54] MANUAL CHAIN BLOCK

[75] Inventors: Yoshio Ueno; Yasuo Wada; Munenobu Honda, all of Sayama, Japan

[73] Assignee: Elephant Chain Block Company, Ltd., Osaka, Japan

[21] Appl. No.: 303,199

[22] Filed: Sep. 8, 1994

[30] Foreign Application Priority Data

Sep. 14, 1993 [JP] Japan ..... 5-229281
Sep. 14, 1993 [JP] Japan ..... 5-229282

[51] Int. Cl.[6] ..... B66D 3/26

[52] U.S. Cl. ..... 254/352; 254/365

[58] Field of Search ..... 254/365, 352, 254/358

[56] References Cited

U.S. PATENT DOCUMENTS 2,243,361 5/1941 Stahl .
4,664,357 5/1987 Nishimura ..... 254/358

FOREIGN PATENT DOCUMENTS 0602946 6/1994 European Pat. Off. .
1053220 2/1954 France .
1043610 6/1953 Germany .
62-16477 4/1987 Japan .
16906 1/1916 United Kingdom .

*Primary Examiner*—Katherine Matecki
*Attorney, Agent, or Firm*—Watson Cole Stevens Davis, P.L.L.C.

[57] ABSTRACT

One of the hand wheel and the brake ratchet wheel is provided with a cover portion extending toward the other thereof and having a circular peripheral surface which covers the lining plate, and the other of the hand wheel and the brake ratchet wheel is provided with a circular opposite peripheral surface opposed to the circular peripheral surface, so that opposite peripheral surfaces of those circular peripheral surfaces can be arranged adjacently to each other or have a scaling member interposed therebetween. Therefore, even when dust and rainwater enter a wheel cover for a hand wheel, these dust and rainwater can be prevented from further entering a mechanical brake.

3 Claims, 6 Drawing Sheets

MANUAL CHAIN BLOCK

BACKGROUND OF THE INVENTION

1. Field of the Invention

The present invention relates to a manual chain block which is provided with a drive member having a hand wheel and a mechanical brake and is adapted to drive a load sheave through the mechanical brake by an operation of the hand wheel.

2. Description of Prior Art

In a conventional manual chain block, for example as disclosed in the Japanese Utility Model Publication No. Sho. 62 (1987)-16477, a load sheave is rotatably supported between a pair of side plates, a drive shaft is inserted into a central shaft portion of the load sheave, a hand wheel is threadably secured to an axial one side portion of the drive shaft, a mechanical brake is interposed between the hand wheel and the drive shaft and a reduction gear mechanism is disposed in the axial other side portion of the drive shaft, such that when the hand wheel is operated, the drive shaft is driven through the mechanical brake and the load sheave is driven through the reduction gear mechanism. Further, a hook is disposed between the side plates, a wheel cover for covering the mechanical brake and the hand wheel is attached to one of the side plates and a gear cover for covering the reduction gear mechanism is attached to the other side plate.

The manual chain block having the above-mentioned structure is used not only inside of a building such as a factory but also outdoors, for example at a building site. Though the manual chain block is provided with the wheel cover for covering the mechanical brake and the hand wheel, a chain introducing opening through which a hand chain looped around the hand wheel passes is opened in a side wall of the wheel cover.

Accordingly, when the manual chain block is used outdoors, rainwater enters an interior of the wheel cover through the chain introducing opening during a rainy weather working. Further, when the manual chain block is used at a fine weather day or inside of the building, especially within a dusty atmosphere, dust such as fine sand grains enter the wheel cover through the chain introducing opening.

When the rainwater and the dust enter the wheel cover as mentioned above, they come to be interposed between lining plates constituting the mechanical brake, namely a lining plate interposed between the hand wheel and a brake ratchet wheel and a lining plate interposed between the brake ratchet wheel and a driven member, and respective braking surfaces of the hand wheel, the ratchet wheel and the driven member to which those lining plates are opposed, so that comes out such a problem that a braking performance and a brake releasing performance of the mechanical brake change due to that interposition.

Also has been proposed such a chain block that has the above-mentioned structure as well as an overload preventive mechanism disposed in the drive shaft on its hand wheel side.

This overload preventive mechanism comprises a lining plate interposed between a drive member and a hand wheel on the drive shaft, a resilient member and a load setting and adjusting member and serves to set a slipping load of the hand wheel relative to the drive member by adjusting a pushing force of the resilient member relative to the lining plate by turning the load set ting and adjusting member.

At the time of a load lifting working, when the hand wheel is normally driven by pulling an endless hand chain looped around the hand wheel, the drive member is threadably advanced relative to the drive shaft and then the drive shaft is driven through a transmission mechanism provided with the mechanical brake. As the drive shaft is driven in that way, the load sheave is rotated through the reduction gear mechanism so that a load can be lifted by a load chain looped around the load sheave.

During the load lifting working, when a load larger than the slipping load set by the load setting and adjusting member of the overload preventive mechanism acts on a load side, namely a load chain side, the hand wheel slips relative to the drive member, so that the load lifting after that can be stopped and a level of the lifted load can be maintained by an action of the mechanical brake.

Further, at the time of lowering the lifted load, when the hand wheel is reversely rotated by operating the hand chain, the drive member is threadably retreated relative to the drive shaft and then the load sheave is reversed by repetitions of an action and an inaction of the mechanical brake so that the load lowering can be carried out gradually.

Well, also in the above conventional structure, the overload preventive mechanism and the transmission mechanism are protected by a wheel cover disposed around the outer periphery of the hand wheel. But, since the chain introducing opening is formed in the wheel cover, dust tends to enter an interior of the wheel cover through the chain introducing opening and, at the time of outdoor use, not only the dust but also the rainwater enter through the chain introducing opening, so that these dust and rainwater and the likes happen to enter between respective component members of the overload preventive mechanism and the transmission mechanism.

Then, when the dust and the rainwater enter the overload preventive mechanism, a coefficient of friction and the like of the lining plate of the overload preventive mechanism change and then the slipping load set by the load setting adjusting member changes at its convenience. For example, when the dust enters, the coefficient of friction of the lining plate becomes larger. Accordingly, even though a load larger than the slipping load set by the load setting and adjusting member acts on the load sheave, the hand wheel doesn't slip relative to the drive member to further continue the load lifting working. When the rainwater enters, the coefficient of friction of the lining plate becomes so smaller that the hand wheel starts to slip relative to the drive member at a smaller value than the slipping load set by the load setting and adjusting member to stop the load lifting working.

SUMMARY OF THE INVENTION

It is an object of the present invention to solve such a problem that a braking performance and a brake releasing performance of the mechanical brake change, by restraining rainwater and dust from entering a mechanical brake even when the rainwater and the dust enter an interior of a wheel cover.

It is another object of the present invention to provide a manual chain block which is capable of preventing the dust and the like from entering an overload preventive mechanism so as to prevent a slipping load from being disordered.

Thus, for accomplishing the above-mentioned object, as shown in FIGS. 1 through 5, the invention resides in a manual chain block including a load sheave 3 which is supported rotatably between a pair of side plates 1, 2, a drive shaft 7 for driving the load sheave 3, a driven member 22 to be coupled to the drive shaft 7, a hand wheel 8 threadably secured to the drive shaft 7, a brake ratchet wheel 24 having a teeth portion 4a formed in its outer peripheral portion, a brake pawl 28 adapted to engage with the teeth portion 24*a* of the brake ratchet wheel 24 and lining plates 25, 26, wherein one of the hand wheel 8 and the brake ratchet wheel 24 is provided with a cover portion 30 extending toward the other thereof and having a circular peripheral surface 30*a* which covers the lining plate 26 located axially outside the brake ratchet wheel 24, and the other of the hand wheel 8 and the brake ratchet wheel 24 is provided with a circular opposite peripheral surface 30*b* opposed to the circular peripheral surface 30*a* of the cover portion 30, so that the circular peripheral surface 30*a* of the cover portion 30 and the circular opposite peripheral surface 30*b* are arranged adjacently to each other.

In the above-mentioned structure, it is preferable to interpose a sealing member between the circular peripheral surface 30*a* of the cover portion 30 and the circular opposite peripheral surface 30*b* opposed to the circular peripheral surface.

Further, the brake ratchet wheel 24 may be provided at its outer peripheral portion with a cylindrical portion 31 which extends axially inwardly relative to its boss portion 24*b* to cover the lining plate 25 interposed between the driven member 22 and the brake ratchet wheel 24, and this cylindrical portion 31 may be preferably provided at its outer peripheral surface with the teeth portion 24*a* with which the brake pawl 28 engages. It is preferable that the cylindrical portion 31 of the brake ratchet wheel 24 covers an outer peripheral surface 22*b* of the driven member 22 and a seal member 53 is interposed between this outer peripheral surface 22*b* and an inner peripheral surface 31 a of the cylindrical portion 31.

The present invention further resides in a manual chain block, as shown in FIGS. 6 through 1 2, which has an overload preventive mechanism 21 comprising lining plates 30, 31, a resilient member 33 and a load setting and adjusting member 34, interposed between the drive member 23 and the hand wheel 8 in addition to a structure of the above mechanical brake, wherein the hand wheel 8 is provided at its boss portion 8*a* with a cover 90 which has a inner peripheral surface adjacent to a flange of the drive member 23 and the outer peripheral surface of the load setting and adjusting member 34 and covers the overload preventive mechanism 21.

It is preferable to form the cover 90 by a cylindrical member and to integrally connect an axial one end thereof to the boss portion 8*a* of the hand wheel 8. Further, it is preferable to attach an end plate 91 located outside the load setting and adjusting member 34 to cover an axial outer portion of the overload preventive mechanism 21, to an axial outer end portion of the cover 90.

Further, a shaft end portion of the drive shaft 7 on the overload preventive mechanism side may be extended outwardly beyond the overload preventive mechanism 21 to be journaled on the side of the wheel cover 15, a wheel stopper 40 for restraining its axial outward movement of the hand wheel 8 may be disposed in the extended portion of the drive shaft 7, an end plate 92 for covering an axial outer portion of the load setting and adjusting member 34 may be attached to the axial outer end portion of the cover 90, and an inner peripheral surface 92*a* adjacent to an outer peripheral surface of the wheel stopper 40 may be formed in the end plate 92.

Further, it is preferable to interpose a seal member 93 between the inner peripheral surface 92*a* of the end plate 92 and the outer peripheral surface 41 a of the wheel stopper 40. The cover 90 may be preferably provided with an extended portion 90A extending axially inwardly relative to the boss portion 8*a* of the hand wheel 8 to make an inner peripheral surface of an extended end portion of the extended portion 90A adjacent to an outer peripheral portion of the brake ratchet wheel 24.

According to the invention constructed as mentioned above, the following effects and advantages can be obtained.

That is, since one of the hand wheel 8 and the brake ratchet wheel 24 is provided with a cover portion 30 extending toward the other thereof and having a circular peripheral surface 30*a* which covers the lining plate 26 located axially outside the brake ratchet wheel 24 and the other of the hand wheel 8 and the brake ratchet wheel 24 is provided with a circular opposite peripheral surface 30*b* opposed to the circular peripheral surface 30*a* of the cover portion 30 so that the circular peripheral surface 30*a* of the cover portion 30 and the circular opposite peripheral surface 30*b* are arranged adjacently to each other, it is possible to prevent rainwater and dust from entering between the lining plate 26, interposed between the brake ratchet wheel 24 and the hand wheel 8, and braking surfaces of the brake ratchet wheel 24 and the hand wheel 8 opposed to the lining plate 26. Further, it is possible to avoid changes of a braking performance and a brake releasing performance of the mechanical brake which might be caused by entering of the rainwater and the dust.

When a sealing member 50 or 52 is interposed between the circular peripheral surface 30*a* of the cover portion 30 and the circular opposite peripheral surface 30*b* opposed to the circular peripheral surface, it is possible to more effectively prevent entering of the rainwater and the dust without affecting the braking performance of the mechanical brake.

Further, when the brake ratchet wheel 24 is provided at its outer peripheral portion with the cylindrical portion 31 which extends axially inwardly relative to its boss portion 24*b* to cover the lining plate 25 interposed between the driven member 22 and the brake ratchet wheel 24, it is possible to restrain the rainwater and the dust from entering also between the lining plate 25 and the braking surfaces of the driven member 22 and the brake ratchet wheel 24 opposed to the lining plate 25 as well as it is possible to more effectively avoid changes of the braking performance the brake releasing performance of the mechanical brake. When the cylindrical portion 31 of the brake ratchet wheel 24 covers the outer peripheral surface 22*b* of the driven member 22 and the sealing member 53 is interposed between this outer peripheral surface 22*b* and the inner peripheral surface 31*a* of the cylindrical portion 31, it is possible to prevent the rainwater and the dust from entering between the lining plate 25 and the braking surfaces of the brake ratchet wheel 24 and the driven member 22 opposed to the lining plate 25.

Further, in a chain block provided with the overload preventive mechanism, when the hand wheel 8 is provided at its boss portion 8*a* with a cover 90 which has a inner peripheral surface adjacent to a flange of the drive member 23 and the outer peripheral surface of the load setting and adjusting member 34 and covers the overload preventive mechanism 21, even when the dust and the rainwater enter the interior of the wheel cover 15 of the hand wheel 8, it is possible to prevent these dust and rainwater from entering the respective component members of the overload preventive mechanism 21. Accordingly, it is possible to prevent a change of the slipping load which is set by the load setting and adjusting member 34 and might be changed by changes of the coefficient of friction and the like of the lining plate 31 constituting the overload preventive mechanism 21, and it is possible to carry out a safe load lifting working by driving the load sheave 3 based on the slipping load previously set by the load setting and adjusting member 34.

In the above-mentioned structure, when the cover 90 is formed by the cylindrical member and the axial one end thereof is integrally connected to the boss portion 8*a* of the hand wheel 8, it is possible to constitute a sealing structure by making use of the hand wheel 8. Accordingly, it is possible to simplify the structure and to prevent the dust and the rainwater from entering the respective component members of the overload preventive mechanism 21.

Further, when the end plate 91 located outside the load setting and adjusting member 34 to cover the axial outside portion of the overload preventive mechanism 21 is attached to the axial outer end portion of the cover 90, it is possible to effectively cover the overload preventive mechanism 21 by both the cover 90 and the end plate 91. Accordingly, it is possible to effectively prevent not only the dust but also the rainwater from entering the respective component members of the overload preventive mechanism 21. That is, when the dust enters, the coefficient of friction of the lining plate 31 becomes so large that even when a load larger than the slipping load set by the load setting and adjusting member 34 acts on the load sheave 3, the hand wheel 8 doesn't slip relative to drive member 23 to further continue the load lifting working. On one hand, when the rainwater enters, the coefficient of friction of the lining plate 31 becomes so smaller that the hand wheel 8 starts to slip relative to the drive member 23 at a smaller value than the slipping load set by the load setting and adjusting member 34 to stop tile load lifting working. But, since the enterings of the dust and the rainwater can be prevented, it is possible to carry out the safe load lifting working by driving the load sheave 3 based on the slipping load previously set by the load setting and adjusting member 34.

Further, when the shaft end portion of the drive shaft 7 on the overload preventive mechanism side is extended outwardly beyond the overload preventive mechanism 21 to be journaled on the side of the wheel cover 15, it is possible to improve a supporting strength of the drive shaft 7. Accordingly, at the time of driving operation of the hand wheel 8, even through a load is large, it is possible to decrease a shaft deflection, to prevent a shaft deformation, to improve an efficiency of transmission of the driving force and to improve an operability of the hand wheel. Further, since the wheel stopper 40 for restraining its movement in the axial outward direction of the hand wheel 8 is disposed in the extended portion of the drive shaft 7 and the end plate 92 for covering the axial outside portion of the load setting and adjusting member 34 is attached to the axial outer end portion of the cover 90 as well as the inner peripheral surface 92*a* adjacent to an outer peripheral surface of the wheel stopper 40 is formed in the end plate 92, as mentioned above, it is possible to obtain such an effect as to improve the supporting strength of the drive shaft 7 and to prevent the dust and the like from entering the respective component members of the overload preventive mechanism 21 even though the cover 90, the end plate 92 and the wheel stopper 40 constitute a simple structure.

Further, since the seal member 93 is interposed between the inner peripheral surface 92*a* of the end plate 92 and the outer peripheral surface 41*a* of the wheel stopper 40, it is possible to seal a gap between the inner peripheral surface 92*a* of the end plate 92 and the outer peripheral surface 41*a* of the wheel stopper 40 by the sealing member 93. Accordingly, it is possible to more surely prevent the dust and the rainwater from entering the respective component members of the overload preventive mechanism 21.

BRIEF DESCRIPTION OF THE DRAWINGS

The above and other objects, advantages and features of the invention will become apparent when considered with the following specification and accompanying drawings wherein.

DESCRIPTION OF THE PREFERRED EMBODIMENTS

Figure 1:
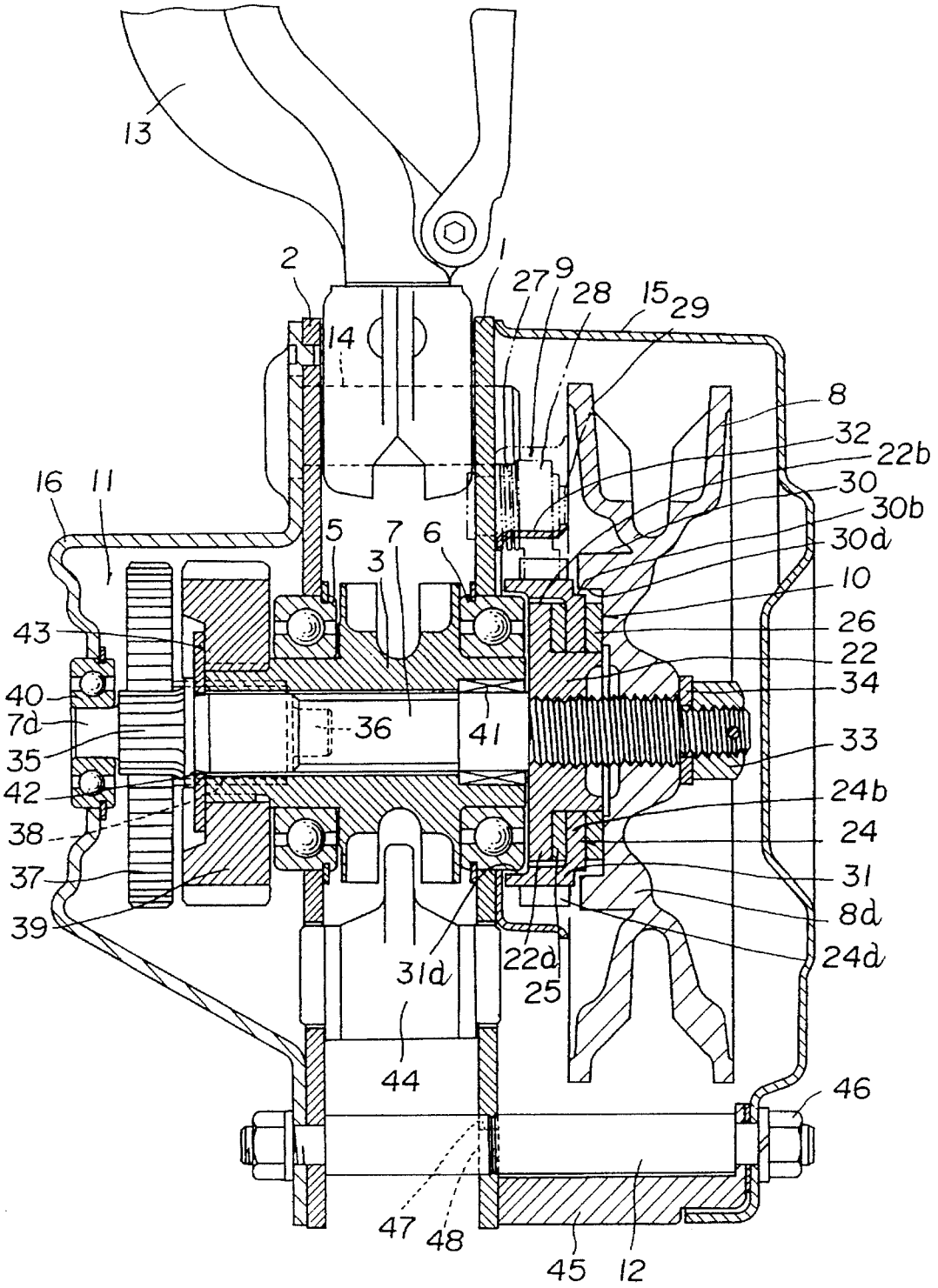
FIG. 1 is a vertical sectional view showing a first embodiment of a manual chain block according to the present invention.

A manual chain block illustrated in FIG. 1 is a one according to a representative embodiment, in which a load sheave 3 is rotatably supported between a pair of first and second side plates 1, 2 through bearings 5, 6. A drive shaft 7 is passed through a shaft bore of the load sheave 3, a hand wheel 8 is threadably secured to an axial one end thereof, a transmission mechanism 10 provided with a mechanical brake 9 is interposed between the hand wheel 8 and the drive shaft 7, and a reduction gear mechanism 11 having a plurality of reduction gears is disposed on the axial other end side of the drive shaft 7. A driving force is transmitted to the load sheave 3 through the transmission mechanism 10 and the reduction gear mechanism 11 by a driving operation of the hand wheel 8, so that a load chain looped around the load sheave 3 can be wound up and wound down.

When explaining more in detail, the side plates 1, 2 are connected to each other by a plurality of stay bolts 12 with keeping a predetermined space therebetween. A shaft 14 for mounting a hook 13 is attached between upper portions of those side plates 1, 2 at a one side position along the tangential direction of the load sheave 3.

While a wheel cover 15 for covering the transmission mechanism 10 and the hand wheel 8 is attached to the first side plate 1, a gear cover 16 for covering the reduction gear mechanism 11 is attached to the second side plate 2.

The transmission mechanism 10 comprises a driven member 22 joined to the drive shaft 7 so as not to rotate relatively thereto ( threadably jointed to each other in FIGS. ) and having a flange 22*a* on its axial one side, the hand wheel 8, a brake ratchet wheel 24 interposed between the flange 22*a* of the driven member 22 and a boss portion 8*a* of the hand wheel 8 and rotatably supported by the driven member 22 and lining plates 25, 26 interposed respectively between the flange 22*a* of the driven member 22 and the brake ratchet wheel 24 and between the brake ratchet wheel 24 and the boss portion 8*a* of the hand wheel 8. A brake pawl 28 resiliently urged by a pawl spring 27 toward the brake ratchet wheel 24 and adapted to mesh with a teeth portion 24*a* of the following teeth type formed in the outer peripheral portion of the brake ratchet wheel 24 is swingably pivoted on the first side plate 1 through a pawl shaft 29. This brake pawl 28, the brake ratchet wheel 24, the driven member 22, the hand wheel 8 and the lining plates 25, 26 constitute the mechanical brake 9.

The above-mentioned structure has been already known, and the first embodiment illustrated in FIG. 1 has the following structure added to the above-mentioned structure. That is, the hand wheel 8 has a cover portion 30 formed integrally at its boss portion 8*a*. The cover portion 30 has a circular peripheral surface 30*a* which extends toward the brake ratchet wheel 24 and covers the lining plate 26 interposed between the brake ratchet wheel 24 and the hand wheel 8. The brake ratchet wheel 24 has a cylindrical portion 31 formed integrally at its outer peripheral portion. The cylindrical portion 31 extends axially inwardly relative to the boss portion 24*b* of the ratchet wheel 24, namely toward the first side plate 1 to cover the lining plate 25 interposed between the driven member 22 and the brake ratchet wheel 24, and this cylindrical portion 31 has the teeth portion 24*a* formed at its outer peripheral surface. A circular opposite peripheral surface 30*b* opposed to the circular peripheral surface 30*a* of the cover portion 30 is formed in the brake ratchet wheel 24 on the axial outside, namely outside the teeth portion 24*a* so that the circular peripheral surface 30*a* of the cover portion 30 is arranged adjacently to the circular opposite peripheral surface 30*b* as well as an axial inside inner peripheral surface 31*a* of the cylindrical portion 31 of the brake ratchet wheel 24 is arranged adjacently to an outer peripheral surface of an outer race of the bearing 6 through the flange 22*a* of the driven member 22.

Incidentally, the first side plate 1 is provided with a cup-shaped cover body 32 which extends toward the inside surface of the hand wheel 8 to cover the brake ratchet wheel 24, the pawl shaft 29 and the brake pawl 28, and an inside end portion of the cylindrical portion 31 of the brake ratchet wheel 24 is disposed adjacently to the cup-shaped cover body 32.

In the above-mentioned structure, sealing portions are provided between the circular peripheral surface 30*a* of the cover portion 30 and tile circular opposite peripheral surface 30*b* of the brake ratchet wheel 24, between the inner peripheral surface 31*a* of the cylindrical portion 31 of the brake ratchet wheel 24 and the outer peripheral surface 22*b* of the flange 22*a* and between the cylindrical portion 31 and the cup-shaped cover body 32 respectively, so that these sealing portions can prevent the rainwater and the dust which have entered the interior of the wheel cover 8 from further entering the mechanical brake 9, when explaining in detail, from entering between the lining plate 25 and the braking surfaces of the driven member 22 and the brake ratchet wheel 24 opposed to the lining plate 25 and between the lining plate 26 and the braking surfaces of the brake ratchet wheel 24 and the hand wheel 8 to avoid changes of the braking performance and the brake releasing performance of the mechanical brake 9 which might be caused by the enterings of the rainwater and the dust.

Incidentally, in FIG. 1, the symbol 33 designates a nut threadably secured to the shaft end portion of the drive shaft 7, and the symbol 34 does a washer interposed between the boss portion 8*a* of the hand wheel 8 and the nut 33. The symbol 35 designates a first gear constituting the reduction gear mechanism 11 and formed integrally in a shaft end portion of the drive shaft 7 by means of a cold forging. The symbol 36 designates an intermediate shaft rotatably supported between the second plate 2 and the gear cover 16 and provided with a second gear 37 and a third gear 38 which mesh with the first gear 35, and the symbol 39 does a fourth gear meshed with the third gear 38 and connected to a cylindrical shaft portion of the load sheave 3.

The symbol 40 designates a radial bearing for the drive shaft 7 disposed in the gear cover 16 to rotatably support an extended shaft portion 7*a* axially extending from the first gear 35, and the symbol 41 does a rolling bearing.

Further, the symbol 42 designates a flange portion formed integrally in tile drive shaft 7 together with the first gear 35, and the symbol 43 does a washer engaged with the flange portion 42.

The symbol 44 designates a chain kicker, and the symbol 45 does a cover holding member which holds a lower portion of the wheel cover 15 and is secured between the wheel cover 15 and the first side plate 1 by tightening a nut 46 threadably engaged with the stay bolt 12. The symbol 47 does an angular fitting projection disposed in the cover holding member 45, and the symbol 48 does an angular fitting hole formed in the first side plate 1.

Next, the second embodiment illustrated in FIG. 2 will be explained hereinafter. In this second embodiment, a sealing member 50 is interposed between the circular peripheral surface 30*a* of the cover portion 30 and the circular opposite peripheral surface 30*b* of the brake ratchet wheel 24, and this sealing member 50 is held by the circular opposite peripheral surface 30*b* of the brake ratchet wheel 24.

Thus, it is possible to seal a gap between the circular peripheral surface 30*a* and the circular opposite peripheral surface 30*b* by the sealing member 50 either at the time of braking action and at the time of inaction of the brake, namely regardless of the position of the hand wheel 8. Accordingly, it is possible to more effectively prevent the enterings of the rainwater and the dust without affecting the braking performance of the mechanical brake 9.

Figure 2:
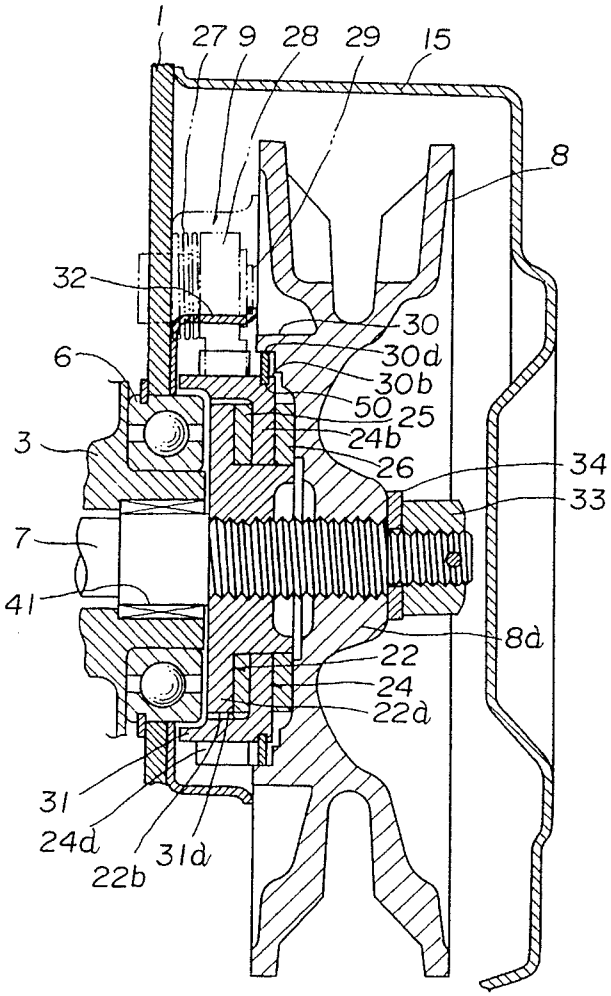
FIG. 2 is a sectional view of a principal portion of a second embodiment thereof.

Incidentally, in the second embodiment illustrated in FIG. 2, the sealing member 50 is a ring-shaped plate member. But, it may be an O-ring. In case that the sealing member 50 is supported by the brake ratchet wheel 24, the outer peripheral surface of the sealing member 50 can be brought into slidable contact with the circular peripheral surface 30*a* of the cover portion 30. But, an annular groove may be formed in this circular peripheral surface 30*a* so that the outer peripheral surface of the sealing member 50 can be put into this annular groove to provide a labyrinth effect for sealing. In this case, the dimension of the annular groove is set to be slightly longer than an axial movement distance of the hand wheel 8.

Next, the third embodiment illustrated in FIG. 3 will be explained hereinafter.

In this third embodiment, the brake ratchet wheel 24 is provided at its outer peripheral portion with a first cylindrical portion 31 extending axially inwardly relative to the boss portion 24*b* similarly to the embodiments illustrated in FIGS. 1 and 2. Besides, a second cylindrical portion 51 extending axially outwardly relative to the boss portion 24*b* is arranged there so as to make the peripheral surface of this second cylindrical portion 51 oppose to the circular peripheral surface 30*a* of the cover portion 30 and to have a sealing member 52, composed of an O-ring and held by the second cylindrical portion 51, interposed between the circular peripheral surface 30*a* and the circular opposite peripheral surface 30*b* of the second cylindrical portion 51 and a sealing member 53, composed of an O-ring and held by the flange 22*a*, interposed between the inner peripheral surface 31*a* of the first cylindrical portion 31 and the outer peripheral surface 22*b* of the flange 22*a* of the driven member 22 opposed to the inner peripheral surface 31*a*.

Thus, it becomes possible to surely prevent the rainwater and the dust from entering between the lining plates 25, 26 constituting the mechanical brake 9 and the respective braking surfaces of the brake ratchet wheel 24, the driven member 22 and the hand wheel 8 opposed to those lining plates 25, 26.

Incidentally, in every above-explained embodiment, the cover portion 30 is disposed in the boss portion 8*a* of the hand wheel 8, its circular peripheral surface 30*a* is arranged adjacently to the circular opposite peripheral surface 30*b* formed in the outer peripheral portion of the brake ratchet wheel 24 or to the circular opposite peripheral surface 30*b* of the second cylindrical portion 51 formed in the brake ratchet wheel 24, and the sealing member 50 or 52 is interposed therebetween. But, like the fourth embodiment illustrated in FIG. 4, the cover portion 30 may be formed in the brake ratchet wheel 24, the circular opposite peripheral surface 30*b* opposed to the circular peripheral surface 30*a* of the cover portion 30 may be formed in the boss portion 8*a* of the hand wheel 8, the circular peripheral surface 30*a* and the circular opposite peripheral surface 30*b* may be arranged adjacently to each other, and the sealing member may be interposed therebetween.

Figure 5:
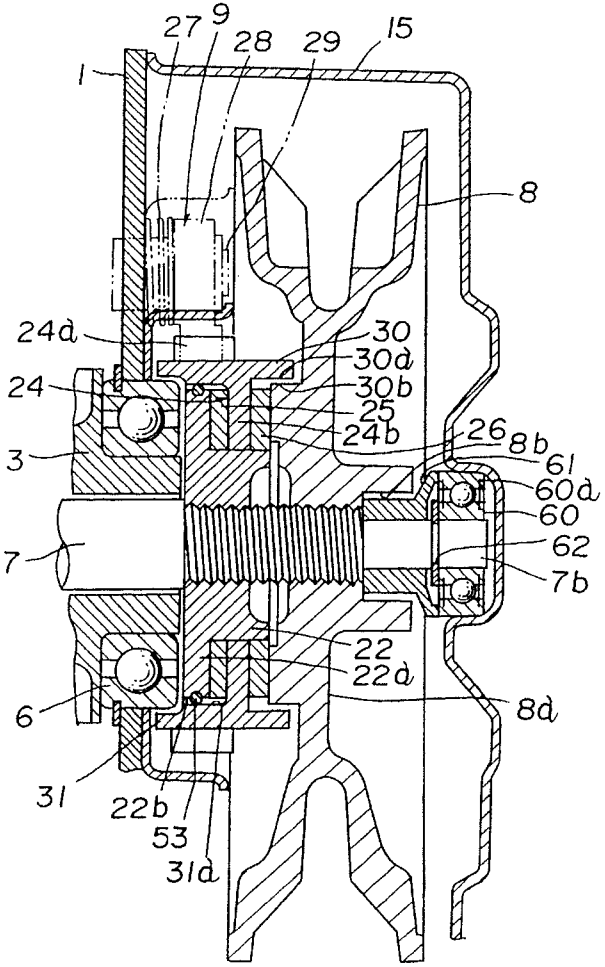
FIG. 5 is a sectional view of a principal portion of a fifth embodiment thereof.

Further, the drive shaft 7 is supported at its axial intermediate portion by the load sheave 3 through the bearing 41. But, like the fifth embodiment illustrated in FIG. 5, a radial bearing 60 may be held by the wheel cover 15, a supported shaft portion 7*b* may be formed by extending the shaft end portion of the drive shaft 7 on the hand wheel side, and this shaft portion 7*b* may be supported by the bearing 60. In this case, a wheel stopper 61 is fitted to the supported shaft portion 7*b*, this wheel stopper 61 is engaged with an outer race 60*a* of the radial bearing 60, and a retaining ring 62 prevents the wheel stopper 61 from being pulled out. In this embodiment, when a bearing with a seal is used as the radial bearing 60 and a receiving concaved portion 8*b* into which the wheel stopper 61 is fitted is formed in the boss portion 8*a* of the hand wheel 8 so that an inner peripheral surface of this receiving concaved portion 8*a* and an outer peripheral surface of the cylindrical portion of the wheel stopper 61 are arranged adjacently to each other and a sealing member is interposed between these inner and outer peripheral surfaces, the rainwater and the like can be prevented from entering a threaded shaft portion of the drive shaft 7 to which the hand wheel 8 is threadably secured.

In the above-mentioned embodiments, the hand wheel 8 is threadably secured to the drive shaft 7. But, like the sixth embodiment illustrated in FIG. 6, an overload preventive mechanism 70 may be mounted thereto.

The overload preventive mechanism 70 has the drive member 23 besides the hand wheel 8 and the cylindrical boss portion 23*a* of this drive member 23 threadably secured to the drive shaft 7 so that the hand wheel 8 can be rotatably supported by this cylindrical boss portion 23*a* in the normal driving direction through a one-way clutch 71. A first lining plate 72 is disposed between a flange portion of the driving member 23 and the boss portion 23*a* of the hand wheel 8, in the cylindrical boss portion 23*a* of the driving member 23 outside the hand wheel 8 there are arranged a second lining plate 73, a pushing plate 74 rotatable with the cylindrical boss portion 23*a* and a resilient member 75 composed of a coned disc spring in order. A load setting and adjusting member 76 for setting the slipping load, at which the hand wheel 8 starts to slip relative to the driving member 23, by adjusting a pushing load of the resilient member 75 is threadably secured to the boss portion 23*a* outside the resilient member 75.

In the sixth embodiment, similarly to the fifth embodiment, the radial bearings 60, 40 are disposed in the wheel cover 15 and the gear cover 16 at the positions opposed to the drive shaft 7 so that the drive shaft 7 is supported at its axial opposite ends by the respective bearings 60, 40 separately from the load sheave 3. That is, one end of the drive shaft 7 is extended toward the gear cover 16 so that the extended portion can be supported by the gear cover 16 through the radial bearing 40, and the other end of the drive shaft 7 is extended toward the wheel cover 15 so that the other end portion of the drive shaft 7 is supported by the wheel cover 15 through the radial bearing 60 fitted in a concaved portion 15*b* formed in the wheel cover 15.

In the above structure, when the hand wheel 8 is normally rotated by an operating of a hand chain 80, the drive shaft 7 is driven through the transmission mechanism 10 having the overload preventive mechanism 70 and the mechanical brake 9, so that this driving force can be transmitted to the load sheave 3 through the reduction gear mechanism 11 to rotate the load sheave 3. Thereupon, a load side of the load chain 4 looped around the load sheave 3, namely the load side for hanging the load through the hook attached to the leading end thereof is wound up to carry out the load lifting working.

During the load lifting working, when a load larger than the slipping load set by the load setting and adjusting member 76 of the overload preventive mechanism 70 is applied to the load side, the hand wheel 8 starts to slip relative to the drive member 23 to stop the further load lifting working and to maintain a level of the lifted load by an action of the mechanical brake 9.

Further, when the lifted load is lowered, the hand wheel 8 is reversed by the operation of the hand chain 80. Thereupon, the drive member 23 is threadably retreated by that reversing of the hand wheel 8 and the load sheave 3 is reversed by repetition of an action and an inaction of the mechanical brake 9 to carry out the load lowering gradually. Thus, the sixth embodiment illustrated in FIG. 6 has the following feature added to the above manual chain block. That is, a cover 90 comprising a cylindrical member is formed integrally in the boss portion 8*a* of the hand wheel 8 on its axial outside so that entire outer peripheries of the second lining plate 73, the resilient member 75 and the load setting and adjusting member 76 constituting the overload preventive mechanism 70 can be covered by the cover 90. Similarly to the first embodiment, the cover portion 30 extending inwardly is formed integrally in the boss portion of the hand wheel 8 on its axial inside so that an extended end portion of tile cover portion 30 can be located adjacently to the outer peripheral portion of the brake ratchet wheel 24 to cover entire outer peripheries of the first lining plate 72 of the overload preventive mechanism 70, the flange portion of the drive member 23 constituting the transmission mechanism 10 and the second lining plate 26 constituting the mechanical brake 9.

As mentioned above, when the inner peripheral surface of the axial outer end portion of the cover 90 is arranged adjacently to the outer peripheral surface of the load setting and adjusting member 76 to cover the entire outer peripheries of the second lining plate 73 and the resilient member 75 of the overload preventive mechanism 70 as well as the extended end portion of the cover portion 30 is arranged adjacent to the brake ratchet wheel 24 to cover the entire outer peripheries of the lining plate 72 constituting the overload preventive mechanism 70, the flange portion of the drive member 23 constituting the transmission mechanism 10 and the lining plate 26 constituting the mechanical brake 9, even though the dust and the like happen to enter the interior of the wheel cover 15 through the chain introducing opening 15*a* thereof, it is possible to effectively prevent this dust and the like from entering the respective component members of the overload preventive mechanism 70. Therefore, it is possible to prevent indefinite changes of the slipping load set by the load setting and adjusting member 76, which might be caused by the changes of the coefficients of friction and the like of the lining plates 72, 73 and it is possible to carry out the reliable load lifting working by the load sheave 3 based on the slipping load previously set by the load setting and adjusting member 76. Further, since also the cover portion 30 can prevent the dust from entering the lining plate 26 of the mechanical brake 9, it is possible to avoid indefinte changes of the coefficient of friction and the like of the lining plate 26, to secure a predetermined braking force by the mechanical brake 9 and to carry out a reliable load lowering working through the load sheave 3.

Further, since the cover 90 and the cover portion 30 are formed integrally in a projecting manner in the boss portion 8*a* of the hand wheel 8, it is possible to form the sealing structure by making use of the hand wheel 8. Accordingly, it becomes possible to prevent the dust from entering the respective component members of the overload preventive mechanism 70 and the mechanical brake 9 by a simple structure.

Figure 6:
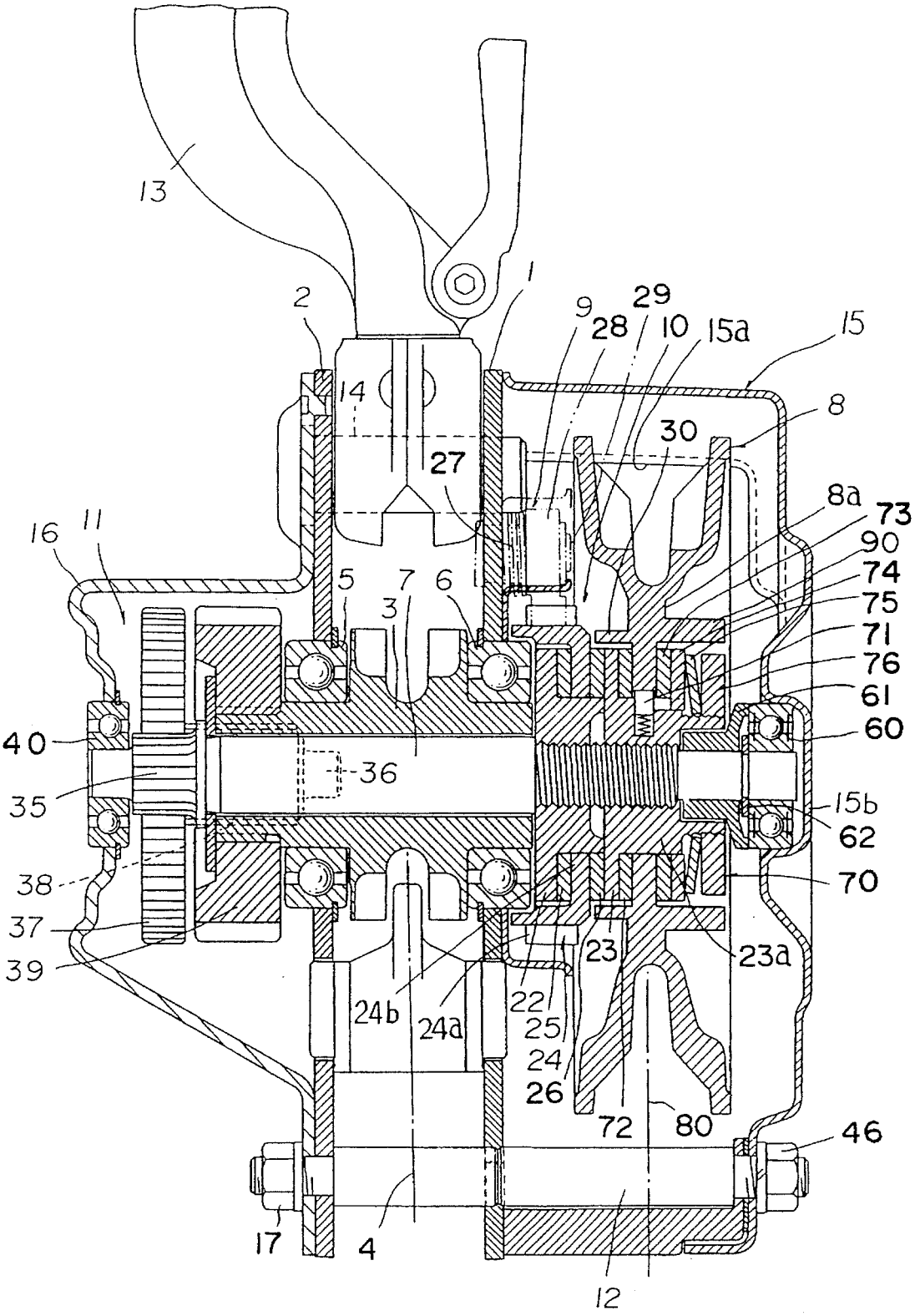
FIG. 6 is a vertical sectional view showing a sixth embodiment thereof.

Further, in the sixth embodiment illustrated in FIG. 6, since the end of the drive shaft 7 on the overload preventive mechanism side is extended toward the wheel cover 15 so that the extended portion thereof is supported by the wheel cover 15 through the radial bearing 60 fitted in a concaved portion 15*b* formed in the wheel cover 15, it is possible to improve the supporting strength for the drive shaft 7 on the driving mechanism side. Therefore, when the load sheave 3 is driven by the operation of the hand wheel 8, it is possible to decrease the deflection of the drive shaft 7 even under a large load and to prevent the shaft deformation. It is possible to improve the transmission efficiency of the driving force to the load sheave 3 and to prevent sounding which might be caused by the shaft deflection.

Next, the seventh embodiment illustrated in FIG. 7 will be explained hereinafter.

In this seventh embodiment, a circular end plate 91 disposed outside the load setting and adjusting member 76 to cover the entire of the axial outer portion of the overload preventive mechanism 70 is attached to the axial outer end portion of the cover 90 by detachable bolts 91*a*.

Thus, the cover 90 and the end plate 91 can surely prevent the dust and the rainwater from entering the respective component members of the overload preventive mechanism 70 and further prevent the rainwater from entering the threaded shaft portion of the drive shaft 7, namely the threaded shaft portion with which the drive member 23 is threadably engaged. Therefore, it is possible to effectively prevent changes of the coefficient of friction and the like of the lining plate 73 constituting the overload preventive mechanism 70 which might be caused by enterings of the dust and the rainwater and to effectively prevent the slipping load set by the load setting and adjusting member 76 from changing at its convenience. Further, it is possible to prevent the threadably advancing and retreating operations of the driving member 23 from becoming bad due to rusting of the drive shaft 7 which is caused by the entering of the rainwater.

Incidentally, as mentioned above, when the end plate 91 for covering the entire axial outer portion of the overload preventive mechanism 70 is attached to the axial outer end portion of the cover 90, differently from the one illustrated in FIG. 6, the radial bearing 60 is not disposed on the other end side of the drive shaft 7, one end side of the drive shaft 7 is supported by the radial bearing 40 and the other end side of the drive shaft 7 is supported by a shaft bore of the load sheave 3 through a bearing such as a needle bearing. A nut 33 which is received in the boss portion 23*a* of the drive member 23 is threadably secured to the shaft end portion of the drive shaft 7 so as to restrain an axial movement of the drive member 23.

Figure 7:
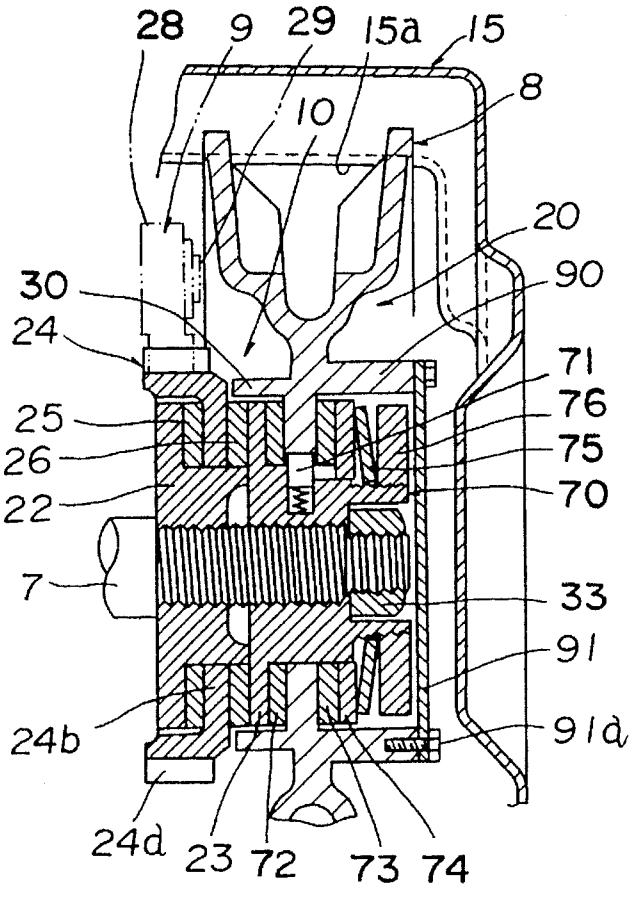
FIG. 7 is a sectional view showing a seventh embodiment thereof.

In the structure illustrated in FIG. 7, when adjusting the load setting and adjusting member 76 of the overload preventive mechanism 70, that adjusting operation can be readily carried out by detaching the wheel cover 15 and detaching the end plate 91.

Figure 8:
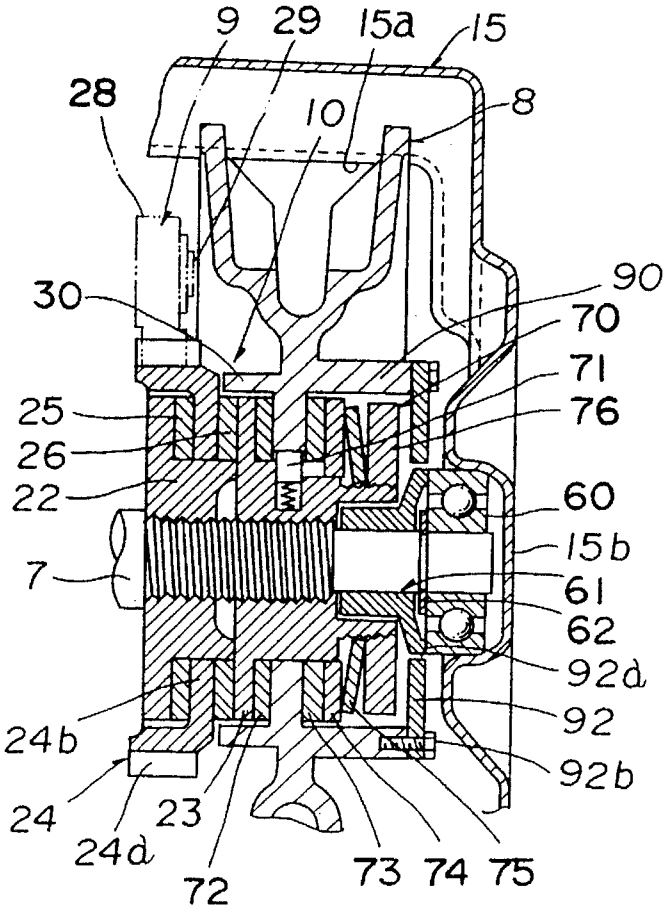
FIG. 8 is a sectional view showing an eighth embodiment thereof.

Next, the eighth embodiment illustrated in FIG. 8 will be explained hereinafter.

In this eighth embodiment, while the supporting structure for the drive shaft 7 as shown in FIG. 6 is converted to such a supporting structure as to support the opposite ends of the drive shaft 7, a doughnut-shaped end plate 92 for covering the axial outer portion of the load setting and adjusting member 76 is detachably mounted to the axial outer end portion of the cover 90 by bolts 92*b* and an peripheral surface 92*a* is formed in the end plate 92 so as to be adjacent to the outer peripheral surface of the wheel stopper 61. Thus, in addition to the structure in which the drive shaft 7 is supported by the wheel cover 15, not only the outer peripheral surface of the overload preventive mechanism 70 can be covered by the cover 90 but also the outside portion of the overload preventive mechanism 70 can be covered by the cover 90. Further, since the inner peripheral surface 92*a* of the end plate 92 is arranged adjacently to the outside outer peripheral surface of the wheel stopper 61, it is possible to effectively prevent the dust and the like from entering the respective component members of the overload preventive mechanism 70 by a simple structure comprising the cover 90, the end plate 92 and the wheel stopper 61.

Accordingly, while the supporting strength for the drive shaft 7 is improved by supporting the drive shaft 7 by the radial bearing 60 to obtain the above-mentioned effects, it is possible to prevent the slipping load set by the load setting and adjusting member 76 from changing at its convenience and to reliably carry out the load lifting working through the load sheave 3 based on the slipping load set by the load setting and adjusting member 76.

Figure 9:
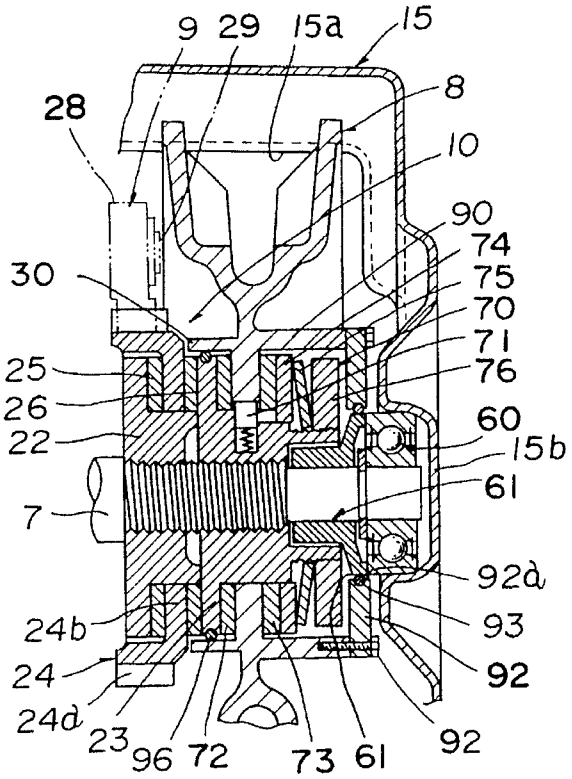
FIG. 9 is a sectional view showing a variant example of the eighth embodiment thereof.

Further, in the ease of the above-mentioned structure, as shown in FIG. 9, it is preferable to interpose a sealing member 93 composed of an O-ring held by the end plate inner peripheral surface 92*a* between the inner peripheral surface 92*a* of the end plate 92 and the outer peripheral surface 61*a* of the wheel stopper 61.

Thus, since a gap between the inner peripheral surface 92*a* of the end plate 92 and the outer peripheral surface 61*a* of the wheel stopper 61 is sealed by the sealing member 93, it is possible to surely prevent not only the dust but also the rainwater from entering the respective component members of the overload preventive mechanism 70.

Incidentally, in FIG. 9, the sealing member 96 composed of the O-ring held by the outer peripheral surface of the flange is interposed between the inner peripheral surface of the cover portion 30 and the outer peripheral surface of the flange portion of the drive member 23.

Further, the sealing structure of the above overload preventive mechanism 70 and the sealing structure of the mechanical brake 9 can be made to co-exist.

Next, a representative example of this co-existing structure will be explained based on the ninth embodiment illustrated in FIG. 10 hereinafter.

Figure 3:
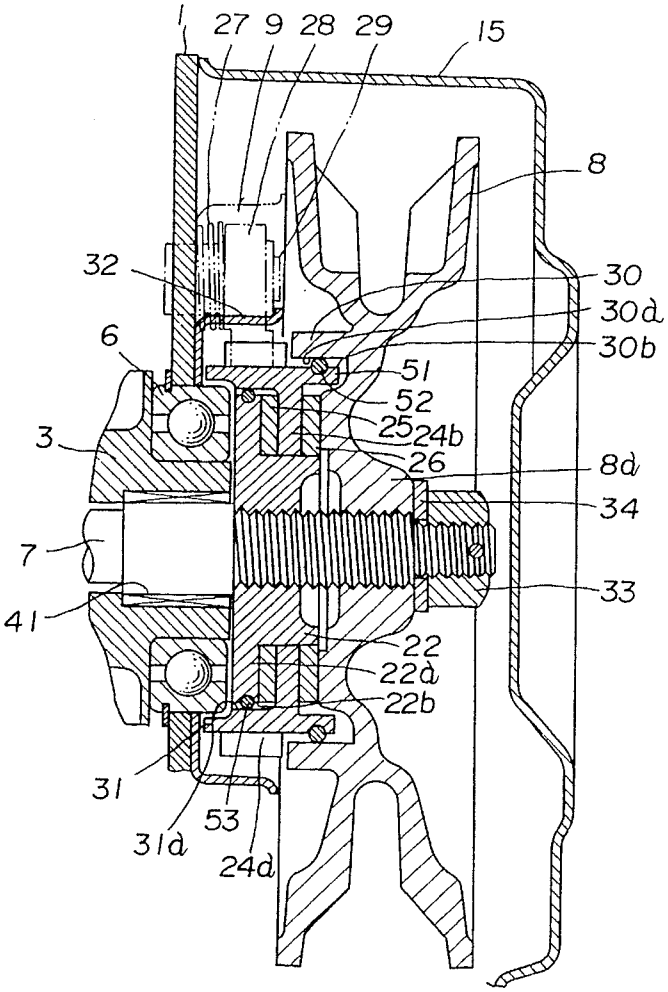
FIG. 3 is a sectional view of a principal portion of a third embodiment thereof.
Figure 10:
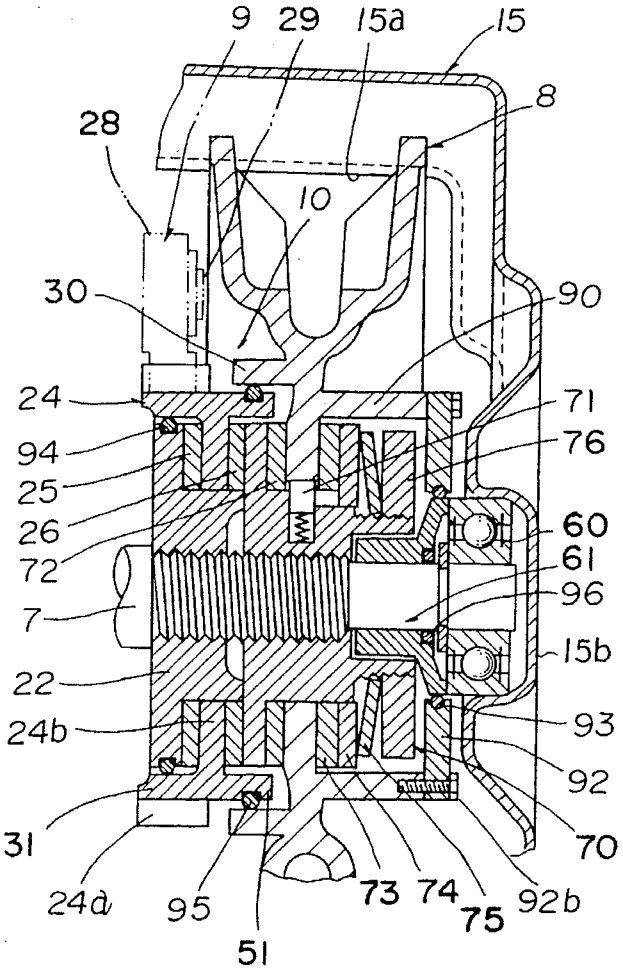
FIG. 10 is a sectional view showing a ninth embodiment thereof.

In the ninth embodiment illustrated in FIG. 10 obtained by combining the third embodiment illustrated in FIG. 3 with the ninth embodiment illustrated in FIG. 9, the cylindrical portion 31 extending axially inwardly relative to the boss portion 24*b* to cover the outer periphery of the flange portion and the lining plate 25 of the driven member 22 and the second cylindrical portion 51 extending axially outwardly relative to the boss portion 24*b* to cover the flange portion of the drive member 23 and the first lining plate 72 of the overload preventive mechanism 70 are formed integrally in the outer peripheral portion of the brake ratchet wheel 24 of the mechanical brake 9, the teeth portion 24*a* with which the brake pawl 28 engages is formed in the outer peripheral surface of the first cylindrical portion 24*c*, and the inner peripheral surface of the extended end portion of the cover 30 disposed in the boss portion 8*a* of the hand wheel 8 is made to overlap the outer peripheral surface of the second cylindrical portion 51 in an adjacent manner. Further, similarly to FIG. 9, the doughnut-shaped end plate 92 for covering the axial outer portion of the load setting and adjusting member 76 is attached to the axial outer end portion of the cover 90, the sealing member 93 is interposed between the inner peripheral surface of the end plate 92 and the outer peripheral surface of the wheel stopper 61, the sealing member 96 is interposed between the outer peripheral surface of the drive shaft 7 and the inner peripheral surface of the wheel stopper 61, the sealing member 94 composed of the O-ring held by the flange portion of the driven member 22 is interposed between the outer peripheral surface of the driven member 22 and the inside outer peripheral surface of the first cylindrical portion 31, and the sealing member 95 composed of the O-ring held by the second cylindrical portion 51 is interposed also between the second cylindrical portion 51 and the cover portion 30.

According to the above structure, since the first cylindrical portion 31 and the second cylindrical portion 51 of the brake ratchet wheel 24 can prevent the dust and the like from entering not only the overload preventive mechanism 70 but also the mechanical brake 9, it becomes possible to prevent the dust and the like from entering both the overload preventive mechanism 70 and the mechanical brake 9, making effective use of the hand wheel 8 and the brake ratchet wheel 24 and to prevent the changes of the coefficient of friction and the like of each lining plate.

Further, since the sealing member 94 is interposed between the inner peripheral surface of the first cylindrical portion 31 and the outer peripheral surface of the flange portion of the driven member 22 as well as the sealing member 95 is interposed between the outer peripheral surface of the second cylindrical portion 51 and the inner peripheral surface of the cover portion 30, even when the drive member 23 is threadably advanced and threadably retreated, sealing functions of these sealing members 94, 95 are never a affected to give reliable sealing functions as well as also the mechanical brake function is not obstructed. Additionally, the sealing member 96 can prevent the dust and the like from entering the threaded shaft portion of the drive shaft 7 to surely give the functions of these overload preventive mechanism 70 and mechanical brake 9.

Though the doughnut shaped end plate 92 is employed in the ninth embodiment illustrated in FIG. 1 0, similarly to the seventh embodiment illustrated in FIG. 7, the disk-like end plate g 1 located outside the load setting and adjusting member 76 to cover the entire axial outer portion of the overload preventive mechanism 70 may be attached to the axial outside end portion of the cover 90 so that this end plate 91 can surely prevent not only the dust but also the rainwater from entering the respective component members of the overload preventive mechanism 70.

Figure 4:
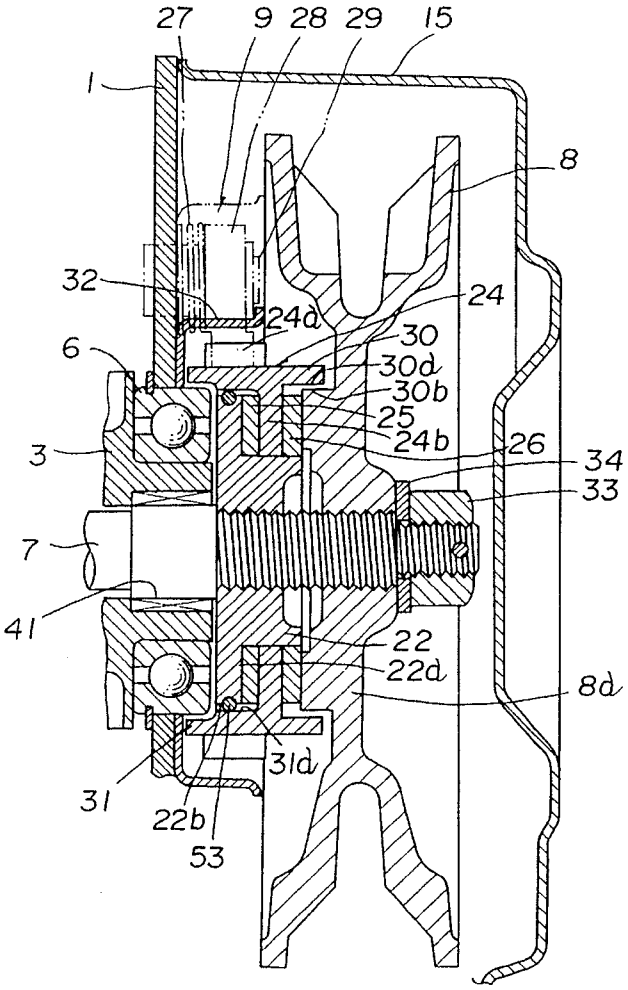
FIG. 4 is a sectional view of a principal portion of a fourth embodiment thereof.

Otherwise, the embodiments applied to the mechanical brake illustrated in FIGS. 1, 2 and 4 may be combined with one another.

It is preferable to employ commercially available bearing with a seal as the radial bearing 18 illustrated in FIGS. 9 and 10. Thereupon, it is possible to more effectively prevent the dust and the rainwater from entering the respective component members of the overload preventive mechanism 70 as well as to prevent them from entering the threaded shaft portion of the drive shaft 7.

As many different embodiments of the invention will be obvious to those skilled in the art, some of which have been disclosed or referred to herein, it is to be understood that the specific embodiments of the invention as presented herein are intended to be by way of illustration only and are not limiting on the invention, and it is to be understood that such embodiments, changes or modifications may be made without departing from the spirit and scope of the invention as set forth in the claims appended therto.

What is claimed is:

1. A manual chain block comprising:

first and second side plates, spaced apart from each other;

a load sheave rotatably supported between the first and second side plates;

a drive shaft for driving the load sheave;

a driven member coupled to the drive shaft and non-rotatable relative to the drive shaft;

a hand wheel threadedly mounted on the drive shaft;

a ratchet wheel rotatably interposed between the hand wheel and the driven member, the ratchet wheel comprising a boss and an outer peripheral portion having teeth;

a brake pawl supported to the first side plate and engageable with the teeth of the ratchet wheel;

lining plates interposed between the ratchet wheel and the hand wheel and between the ratchet wheel and the driven member, respectively;

a cover portion provided at one of the hand wheel and the ratchet wheel, the cover portion having a peripheral surface and extending toward the other of the hand wheel and the ratchet wheel to cover an outer peripheral portion of the lining plate interposed between the ratchet wheel and the hand wheel;

an opposite peripheral surface provided at the other of the hand wheel and the ratchet wheel, the opposite peripheral surface being in opposition to and in close vicinity to the peripheral surface of the cover portion; and a sealing member interposed between the peripheral surface of the cover portion and the opposite peripheral surface opposed thereto.

2. A manual chain block as set forth in claim 1, wherein a cylindrical portion having an outer peripheral surface and an inner peripheral surface is provided at the outer peripheral portion of the ratchet wheel, the cylindrical portion extending axially from the boss toward the first side plate to cover an outer peripheral surface of the lining plate interposed between the driven member and the ratchet wheel, and a sealing member is interposed between an outer peripheral surface of the driven member and the inner peripheral surface of the cylindrical portion.

3. A manual chain block comprising:

first and second side plates, spaced apart from each other;

a load sheave rotatably supported between the first and second side plates;

a drive shaft for driving the load sheave;

a driven member coupled to the drive shaft and non-rotatable relative to the drive shaft;

a hand wheel threadedly mounted on the drive shaft;

a ratchet wheel rotatably interposed between the hand wheel and the driven member, the ratchet wheel comprising a boss and an outer peripheral portion having teeth;

a brake pawl supported to the first side plate and engageable with the teeth of the ratchet wheel;

lining plates interposed between the ratchet wheel and the hand wheel and between the ratchet wheel and the driven member, respectively;

a cover portion provided at one of the hand wheel and the ratchet wheel, the cover portion having a peripheral surface and extending toward the other of the hand wheel and the ratchet wheel to cover an outer peripheral portion of the lining plate interposed between the ratchet wheel and the hand wheel;

an opposite peripheral surface provided at the other of the hand wheel and the ratchet wheel, the opposite peripheral surface being in opposition to and in close vicinity to the peripheral surface of the cover portion;

a cylindrical portion, provided at the outer peripheral portion of the ratchet wheel and having an outer peripheral surface and an inner peripheral surface, the cylindrical portion extending axially from the boss toward the first side plate to cover an outer peripheral surface of the lining plate interposed between the driven member and the ratchet wheel and an outer peripheral surface of the driven member, and also being provided at an outer peripheral surface, on which the teeth with which the brake pawl engages are formed; and a sealing member interposed between the outer peripheral surface of the driven member and the inner peripheral surface of the cylindrical portion.

* * * * *